US007350784B2

(12) United States Patent
Tieken et al.

(10) Patent No.: US 7,350,784 B2
(45) Date of Patent: Apr. 1, 2008

(54) MODIFIED BLACKJACK GAME

(76) Inventors: James B. Tieken, 1737 Choice Hills Dr., Henderson, NV (US) 89012; Karen E. Tieken, 1737 Choice Hills Dr., Henderson, NV (US) 89012

( * ) Notice: Subject to any disclaimer, the term of this patent is extended or adjusted under 35 U.S.C. 154(b) by 156 days.

(21) Appl. No.: 11/345,082

(22) Filed: Feb. 1, 2006

(65) Prior Publication Data

US 2007/0176365 A1 Aug. 2, 2007

(51) Int. Cl.
*A63F 1/00* (2006.01)

(52) U.S. Cl. ..... 273/292; 463/12

(58) Field of Classification Search ..... 273/292, 273/274, 309; 463/12, 13
See application file for complete search history.

(56) References Cited

U.S. PATENT DOCUMENTS 6,869,075 B1 * 3/2005 Stavinsky ..... 273/292
6,869,077 B1 * 3/2005 Ozmulla et al. ..... 273/292
6,877,746 B1 * 4/2005 Herren et al. ..... 273/292
6,938,900 B2 9/2005 Snow
2004/0195770 A1 10/2004 Ornstein
2005/0107149 A1 5/2005 Benbrahim et al.
2005/0242504 A1 11/2005 McKee et al.
2005/0269772 A1 12/2005 Daddona

* cited by examiner

*Primary Examiner*—Benjamin H Layno
(74) *Attorney, Agent, or Firm*—Brinks Hofer Gilson & Lione

(57) ABSTRACT

A method for playing a modified blackjack game between at least a dealer and one player. The method comprises the steps of providing at least one standard deck of playing cards, having at least one player place a wager, wherein the outcome of the wager is determined by conventional blackjack rules of play, allowing the player to place at least a first ante, dealing a first and a second card to the player and the dealer, the player's cards being face down, allowing the player to decide to forfeit his first ante and discard his first and second cards and dealing the player a second set of two additional face down cards, and completing the blackjack game according to conventional blackjack rules of play.

28 Claims, 2 Drawing Sheets

MODIFIED BLACKJACK GAME

BACKGROUND

1. Technical Field

The invention relates generally to the field of casino gaming, and more specifically to a modified blackjack game suitable for multiple players. The invention further relates to a modified blackjack game where the players have the option to discard their original two cards in exchange for forfeiting an ante.

2. Background Information

The basic game of blackjack, or "21" is a well-known and fairly simple casino game. Blackjack is typically played with one or more standard decks of 52 playing cards. Normally, the game is played at a table with the dealer on one side, and an opposite edge where one or more players are positioned. The blackjack table itself may be covered with felt or another material and typically has various markings indicating the locations of the players as well as other information, such as house rules and betting locations.

The object of blackjack is for the player to accumulate a hand of cards having a point total that is greater than the dealer's point total, while at the same time not exceeding twenty-one. Numbered cards have a point value equal to the number on the card. Jacks, queens and kings, or "face" cards, each have a point value of ten. Aces are assigned a point value of one or eleven as determined by the person holding one or more aces. A two-card hand having a point total of twenty-one is known as "blackjack."

Play is normally commenced by each player placing a wager on the outcome of the upcoming hand. The range for the initial wager at the table is typically regulated by the casino. Players usually indicate their wager by placing an appropriate number of chips or markers, each of which has a value assigned to it, in a designated area of the table. After the players place their wagers, the dealer deals cards to each of the players and to himself. Each player and the dealer is initially dealt two cards, and the dealer typically has one card face down and one card face up. The players' cards are typically dealt face up. The dealer normally deals one card to himself, then one card to each player starting from his left and proceeding to his right. The dealer then deals a second card to himself and again deals a second card to each player moving from his left to right.

After the dealer and each player has been dealt an initial hand of two cards, each player in turn elects to receive one or more additional cards ("hit"), or to take no additional cards ("stand"). A player may elect to take additional cards until they decide to stand or until the point total of the player's hand exceeds twenty-one, known as "busting." Once all the players have either received their desired number of cards or have busted, the dealer elects to take cards or to stand. Under most rules, the dealer may not receive additional cards if the dealer's existing hand has a total point value of seventeen or greater, and the dealer is required to take an additional card if the dealer's existing hand has a point total of less than seventeen.

Once all of the players and the dealer have received a desired number of cards or have busted, the hand is complete and outcome of the game is determined. If the dealer has busted, each player that has not busted is paid an amount equal to their initial wager. If the dealer has not busted, each player whose point total exceeds the dealer's point total is paid an amount equal to their initial wager. If the dealer has not busted, each player that has either busted or has a point total less than the dealer's point total that is equal to the dealer's point total keeps his or her initial wager. If the dealer has not busted, each player that has a point total that is the same as the dealer's point total keeps his initial wager. If the dealer has busted and a player has a two-card hand that is equal to twenty one, the player is paid an amount that is equal to one and a half times the amount of their initial wager. If the player has a two-card hand that is equal to twenty-one and the dealer also has a point total of twenty-one, the player keeps their initial wager.

The conventional game of blackjack can be played with one or more decks of standard playing cards.

The conventional game of blackjack described above has been supplemented with a number of alternative betting procedures, including "doubling down," insurance and splitting pairs.

The traditional game of blackjack is easy to learn and is popular with players, but it is a fast moving game without many options. A player can only stay with the cards he has, or hit to add cards from the undealt remainder until he busts or is comfortable with his total. It would be advantageous to give players more choices to give them more control over their destiny. This would also benefit the casino, because players would remain interested in the game for a longer time, and would remain at the table for a longer period.

Furthermore, it is desirable for casinos to be able to stop "advantage players" or "card counters" as they are referred to in the blackjack world. These players are able to gain an advantage over the house by keeping track of the cards previously dealt in earlier hands. By tracking the cards, the player can deduce whether his odds of winning the next hand are better or worse. By counting cards, a player knows when to wager a lot or a little on each hand. Although this practice is legal, it is severely discouraged by casinos. One embodiment of the present invention prevents the practice of card counting, as the cards that are folded by the player are not visible to the other players.

BRIEF SUMMARY

A method for playing a modified blackjack game between at least a dealer and one player is provided. The method comprises the steps of providing at least one standard deck of playing cards, having at least one player place a wager, wherein the outcome of the wager is determined by conventional blackjack rules of play, allowing the player to place at least a first ante, dealing a first and a second card to the player and the dealer, the player's cards being face down, allowing the player to decide to forfeit his first ante and discard his first and second cards and dealing the player a second set of two additional face down cards, and completing the blackjack game according to conventional blackjack rules of play.

In an alternate embodiment, a method for playing a modified blackjack game between at least a dealer and a plurality of players is provided. The method comprises the steps of providing at least one standard deck of playing cards, having each player place a wager, wherein the outcome of the wager is determined by conventional blackjack rules of play, allowing each player to place at least a first ante, dealing a first and a second card to each player and the dealer, each player's cards being face down, allowing each player to decide to forfeit his first ante and discard his first and second cards and dealing that player a second set of two additional face down cards, and completing the blackjack game according to conventional blackjack rules of play.

In another alternate embodiment, a method for playing a modified blackjack game between at least a dealer and one player is provided. The method comprises the steps of providing at least one standard deck of playing cards, having at least one player place a wager, wherein the outcome of the wager is determined by conventional blackjack rules of play, allowing the player to place at least a first ante and a second ante, dealing a first and a second card to the player and the dealer, the player's cards being face down, allowing the player to decide to forfeit his first ante and discard his first and second cards and dealing the player a second set of two additional face down cards, allowing the player to decide to forfeit his second ante and discard his second set of first and second cards and dealing the player a third set of two additional face down cards and completing the blackjack game according to conventional blackjack rules of play.

In yet another alternate embodiment, a method for playing a modified blackjack game between at least a dealer and one player is provided. The method comprises the steps of providing at least one standard deck of playing cards, having at least one player place a wager, wherein the outcome of the wager is determined by conventional blackjack rules of play, allowing the player to place at least a first ante, dealing a first and a second card to the player and the dealer, allowing the player to decide to forfeit his first ante and discard his first and second cards and dealing the player a second set of two additional cards, and completing the blackjack game according to conventional blackjack rules of play.

DETAILED DESCRIPTION OF THE DRAWINGS AND THE PRESENTLY PREFERRED EMBODIMENTS

For purposes of the following detailed description, "completing the hand" refers to when a player receives his requested number of cards from the dealer in addition to the two cards he was originally dealt. At this point, the player "stands" and does not take any additional cards. A new "hand" for the player begins when the dealer deals two new original cards to the player. The term "house" or "the house" refers to the body controlling the blackjack game. This can be the casino, the online gaming site, or a software program, for example.

Figure 1:
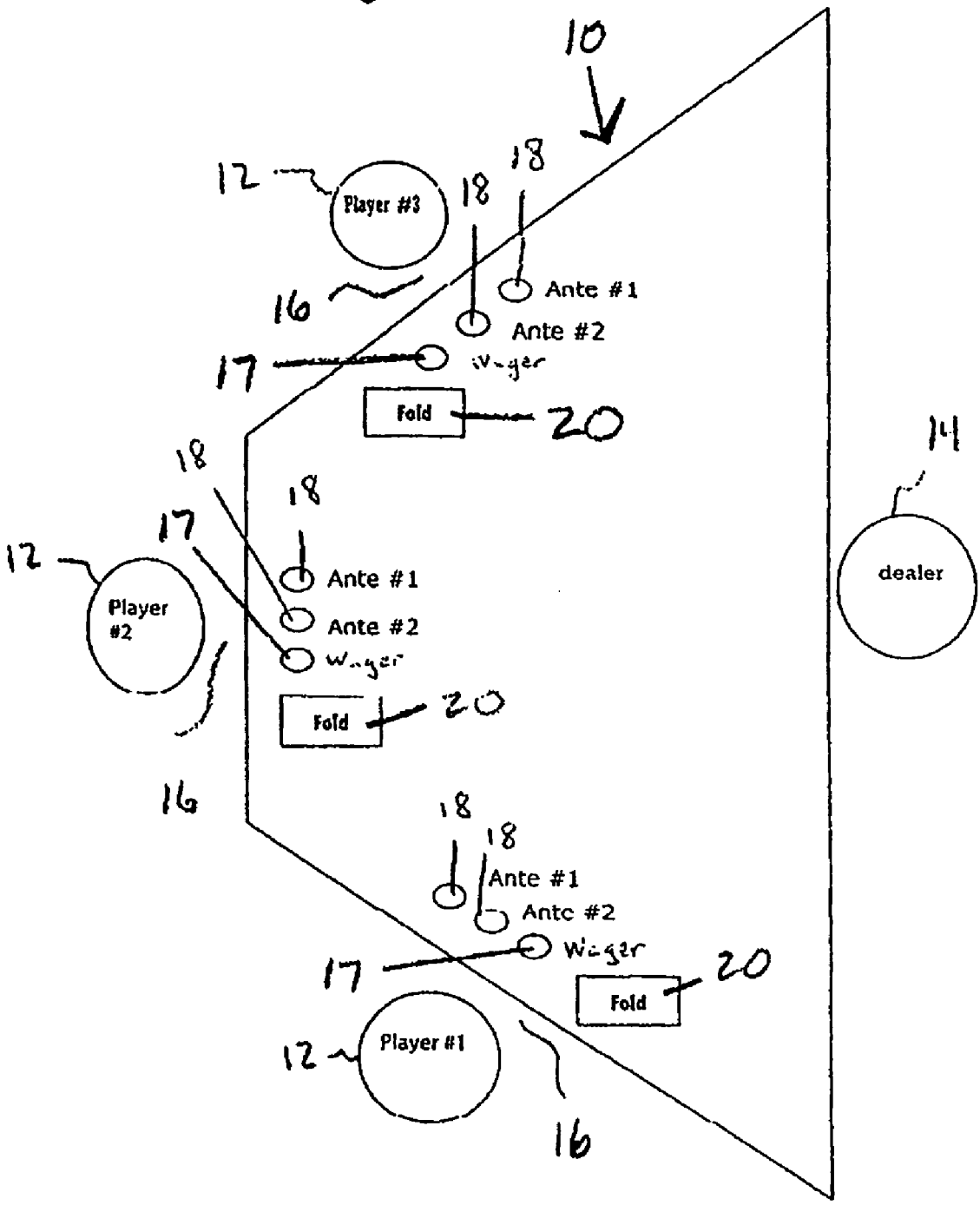
FIG. 1 shows a top view of a modified playing surface that can be used to play the modified blackjack game of the present invention.

Referring now to FIG. 1, a preferred embodiment of the invention is described. FIG. 1 shows a top down view of a modified playing surface that can accommodate the modified blackjack game. The illustrated table 10 is designed for three players 12 and a dealer 14, but a table could be designed to accommodate more or less players. At the table 10 in FIG. 1, three players 12 sit at positions 16 opposite the dealer 14.

The modified blackjack game is played with one or more sets of standard playing cards. The standard deck or decks of playing cards can be physical playing cards, or they can be electronic representations of playing cards. At the outset of the game, the dealer 14 typically shuffles the deck or decks before dealing. Before the deal, each player 12 places a wager on the indicia 17 on the table 10 at their position 16. The wagers can vary in amount, but typically the house sets the maximum and minimum wagers for each table. Conventional blackjack rules of play determine the outcome of the wager.

At this point, each player 12 must make a decision before the cards are dealt. Each player 12 must decide whether to place a first and/or a second ante on the indicia 18 on the table 10. Each ante represents one chance for the player 12 to discard his hand and receive a new set of two cards from the dealer 14, as described below. Under the rules of the illustrated embodiment of the modified blackjack game, a player 12 has the option of placing zero, one or two antes, but the player must place the antes before the dealer 14 deals the cards to the player 12. For example, the first ante can be 10% of the minimum wager, and the second ante can be 20% of the minimum wager, but the antes could take any value, and the house usually sets them before the start of the game. Furthermore, if desired, the house could allow more than 2 antes for each player. This example incorporates a 2-ante maximum.

After each player 12 places his wager and/or his first and/or second antes, the dealer 14 deals a first card face down to each player 12 in turn and a first card to himself. The dealer 14 then deals a second card face down to each player 12 and a second card to himself. In an alternate embodiment of the modified blackjack game, the dealer 14 deals the player's 12 cards face up, but this embodiment does not prevent card-counting. It does not change any other aspects of the game.

After the dealer 14 deals two cards to each player 12 and the dealer 14, the first player 12 to the dealer's left takes his turn. The player 12 has the option of keeping the cards that he has been dealt and completing the game according to conventional blackjack rules, or the player 12 can discard the two cards that he has been dealt. The table 10 can incorporate indicia 20 where the player 12 can place his folded cards. If the player 12 decides to discard, the player 12 forfeits his first ante and the dealer 14 collects it.

If a player 12 has an ante on the table 10, and during his turn elects to discard his hand and forfeit his ante, the game can progress in two alternative styles. The house should decide the preferred progression before the game begins.

In the first game style, all the players 12 take their turns sequentially, and the game plays out according to conventional blackjack rules. If a player 12 discards and forfeits an ante, he must wait until the dealer 14 completes his hand and makes the appropriate payouts to the other players 12 according to conventional blackjack rules. The dealer 14 then deals two new cards to each player 12 that forfeited an ante and himself. After dealing the new cards to the players 12 that originally forfeited an ante the game proceeds as described previously. Players 12 that did not forfeit an ante do not participate and take their unused antes off the table 10.

In the second game style, all the players 12 take their turns sequentially, but once all the players' 12 hands are completed, players 12 that discarded their hands and forfeited an ante are dealt two new cards and given the chance to complete their hand before the dealer 14 completes his hand. Play continues in this fashion until each player 12: A) busts; B) receives his requested number of cards from the dealer 14 and stands; or C) runs out of antes, at which point the dealer 14 completes his hand and makes the appropriate payouts according to conventional blackjack rules.

Furthermore, in either game style, players 12 may not replenish their antes unless the outcome of their wager has been decided. For example, a player 12 that places one ante on the table 10 along with his wager may discard his original 2 cards once. The player must play the second set of two cards the player 12 receives to determine the outcome of his wager. A player 12 that puts down two antes along with his wager may discard his first and his second sets of 2 cards and then the player 12 must play his third set of 2 cards to determine the outcome of his wager. Should a player 12 run out of antes, that player 12 must complete his hand. Once the outcome of a player's 12 wager is determined, the player 12 takes his remaining antes off the table, and may once again decide how many antes to place along with a new wager. Alternatively, the player 12 could simply leave all or some of his antes on the table 10, and place a new wager.

Figure 2:
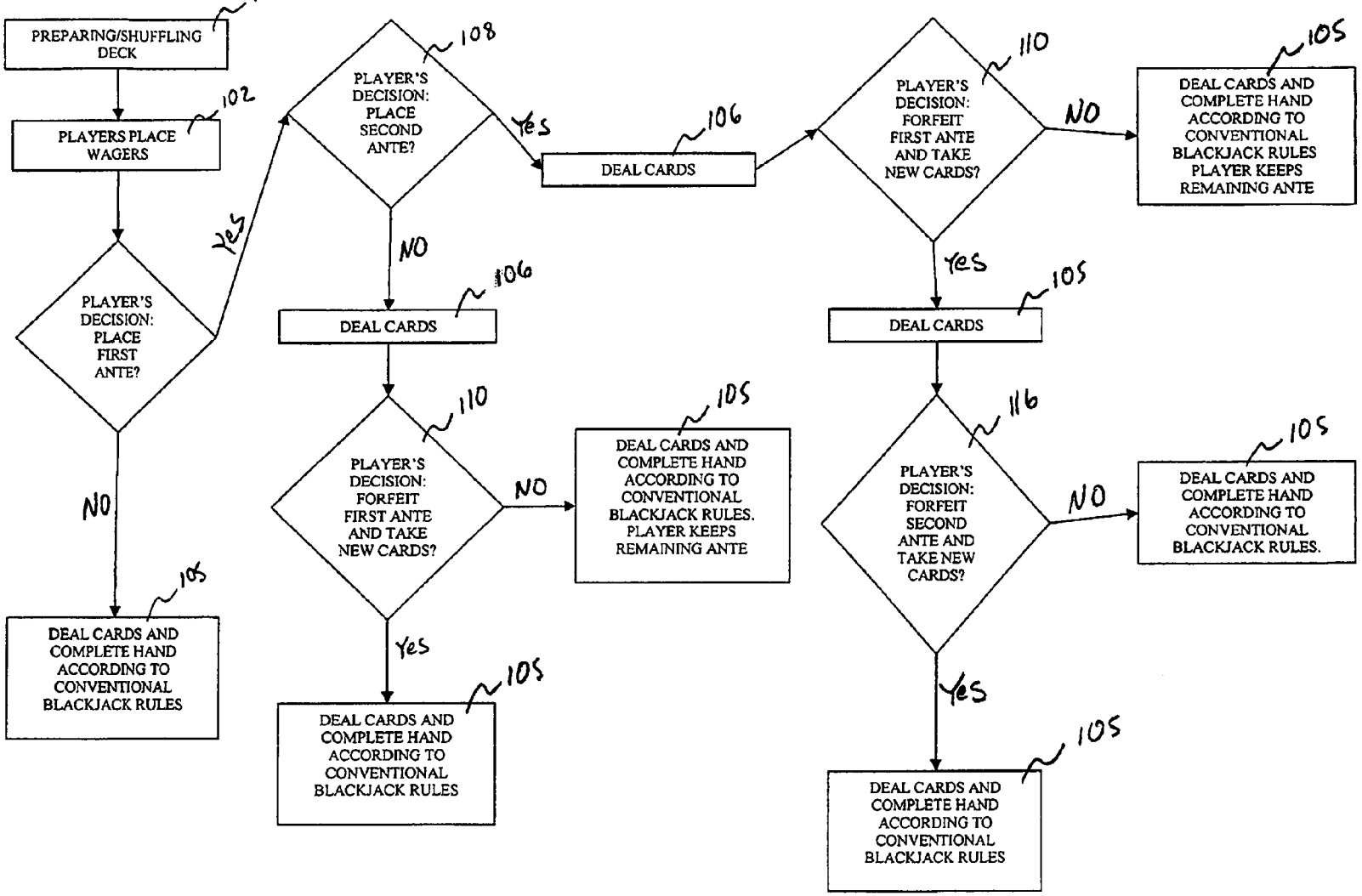
FIG. 2 is a flowchart illustrating the flow of the modified blackjack game using a 2-ante limit.

FIG. 2 is a flowchart illustrating the game's progression using a 2-ante maximum and one player for simplicity. The cards are shuffled 100 and then the player places his wager 102. The player then makes his first decision 104, whether or not to place their first ante. If he does not place the first ante, the dealer deals the cards 105 and the player completes his hand according to conventional blackjack rules 114. If he does place the first ante, the player makes their second decision 108, whether or not to place a second ante. Regardless of whether the player places the second ante or not, in a 2-ante maximum game, the dealer deals the cards 106.

After dealer deals the cards 106, a player that has placed at least a first ante can decide to forfeit his cards and take new cards 110. If he forfeits, the dealer deals him new cards 112. If he does not forfeit, the player completes the hand according to conventional blackjack rules 114.

If the player receives new cards 112, and the player decided to place a second ante, the player can once again decide to forfeit his cards and take new cards 116. If he forfeits, the dealer deals new cards 118. If he does not forfeit, the player completes the hand according to conventional blackjack rules 114. If the player receives new cards 118, under a 2-ante maximum game such as the one illustrated in FIG. 2, the player completes his hand according to conventional blackjack rules 114. It is understood that this example and flowchart are illustrative only, and are not meant to limit the claimed invention.

As an alternative embodiment of the modified blackjack game, the cards are projected onto a display, such as a common computer screen. Furthermore, an electronic representation of the cards and other game elements could be created through the use of hardware or a software program, and these elements could be generated on a display. This allows the method of the present invention to be practiced online, such as through an online gaming service. Alternatively, the game could be played as a stand-alone computer program, or incorporated into stand-alone video game devices similar to electronic slot machines and video poker machines.

It should be noted that there could be a wide range of changes made to the present embodiments without departing from the scope of the claimed invention. For example, more than 2 antes could be allowed per player and the antes could be set at any value desired. The game could be played with any number of standard decks of playing cards. It is therefore intended that the foregoing detailed description be regarded as illustrative rather than limiting, and that it be understood that it is the following claims, including all equivalents, that are intended to define the spirit and scope of this invention.

We claim:

1. A method for playing a modified blackjack game between at least a dealer and one player, comprising the steps of:

providing at least one standard deck of playing cards;

having at least one player place a wager, wherein the outcome of said wager is determined by conventional blackjack rules of play;

allowing said at least one player to reserve a right to discard first and second cards by placing at least a first ante before any cards are dealt;

dealing a first and a second card to said at least one player and said dealer, said at least one player's cards being face down;

allowing said at least one player to decide to forfeit said first ante and exercise the right to discard said at least one player's first and second cards and dealing said at least one player a second set of two additional face down cards; and completing the blackjack game according to conventional blackjack rules of play.

2. The method of claim 1, further comprising the step of allowing said at least one player to place a second ante at the same time as said first ante.

3. The method of claim 2, further comprising the step of allowing said at least one player to decide to forfeit said second ante and discard said second set of two additional face down cards and dealing said at least one player a third set of two additional face down cards before completing the blackjack game according to conventional blackjack rules of play.

4. The method of claim 2, wherein said second ante is twice the value of said first ante.

5. The method of claim 4, wherein said first ante is 10% of the wager and said second ante is 20% of the wager.

6. The method of claim 1, wherein said method is performed with a plurality of decks of standard playing cards.

7. The method of claim 1, wherein there is a plurality of players.

8. The method of claim 1, further comprising the step of creating an electronic representation of said cards.

9. The method of claim 8, further comprising the step of generating said electronic representation onto a display.

10. The method of claim 1, wherein said at least one player discards said at least one player's cards face down.

11. A method for playing a modified blackjack game between at least a dealer and a plurality of players, comprising the steps of:

providing at least one standard deck of playing cards;

having each player place a wager, wherein the outcome of said wager is determined by conventional blackjack rules of play;

allowing each player to reserve a right to discard first and second cards by placing at least a first ante before any cards are dealt;

dealing a first card and a second card to each player and said dealer, said players' cards being face down;

allowing each player in turn to decide to forfeit said first ante and exercise the right to discard said player's first and second cards and dealing said player a second set of two additional face down cards; and completing the blackjack game according to conventional blackjack rules of play.

12. The method of claim 11, further comprising the step of allowing each player to place a second ante at the same time as said first ante.

13. The method of claim 12, further comprising the step of allowing each player to decide to forfeit said second ante and discard said second set of two additional face down cards in exchange for a third set of two additional face down cards before completing the blackjack game according to conventional blackjack rules of play.

14. The method of claim 11, wherein said method is performed with a plurality of decks of standard playing cards.

15. The method of claim 11, further comprising the step of creating an electronic representation of said cards.

16. The method of claim 15, further comprising the step of generating said electronic representation onto a display.

17. The method of claim 11, wherein said at least one player discards said at least one player's cards face down.

18. A method for playing a modified blackjack game between at least a dealer and at least one player, comprising the steps of:

providing at least one standard deck of playing cards;

having at least one player place a wager, wherein the outcome of said wager is determined by conventional blackjack rules of play;

allowing said at least one player place at least a first ante;

allowing said at least one player place a second ante;

dealing a first card and a second card to said at least one player and said dealer, said at least one player's cards being face down;

allowing said at least one player to decide to forfeit said first ante and discard said at least one player's first and second cards and dealing said at least one player a second set of two additional face down cards;

allowing said at least one player to decide to forfeit said second ante and discard said at least one player's second set of two additional face down cards and dealing said at least one player a third set of two additional face down cards; and completing the blackjack game according to conventional blackjack rules of play.

19. The method of claim 18, wherein said method is performed with a plurality of decks of standard playing cards.

20. The method of claim 18, wherein there is a plurality of players.

21. The method of claim 18, further comprising the step of creating an electronic representation of said cards.

22. The method of claim 21, further comprising the step of generating said electronic representation onto a display.

23. The method of claim 18, wherein said at least one player discards said at least one player's cards face down.

24. A method for playing a modified blackjack game between at least a dealer and one player, comprising the steps of:

providing at least one standard deck of playing cards;

having at least one player place a wager, wherein the outcome of said wager is determined by conventional blackjack rules of play;

allowing said at least one player to reserve a right to discard first and second cards by placing at least a first ante before any cards are dealt;

dealing a first and a second card to said at least one player and said dealer;

allowing said at least one player to decide to forfeit said first ante and exercise the right to discard said at least one player's first and second cards and dealing said at least one player a second set of two additional cards or to keep his first ante; and completing the blackjack game according to conventional blackjack rules of play.

25. The method of claim 24, wherein said method is performed with a plurality of decks of standard playing cards.

26. The method of claim 24, wherein there is a plurality of players.

27. The method of claim 24, further comprising the step of creating an electronic representation of said cards.

28. The method of claim 27, further comprising the step of generating said electronic representation onto a display.

* * * * *

UNITED STATES PATENT AND TRADEMARK OFFICE

CERTIFICATE OF CORRECTION

PATENT NO. : 7,350,784 B2
APPLICATION NO. : 11/345082
DATED : April 1, 2008
INVENTOR(S) : James B. Tieken et al.

It is certified that error appears in the above-identified patent and that said Letters Patent is hereby corrected as shown below:

On the Title Page

In column 1, item (76), after "James B. Tieken," delete "1737 Choice Hills Dr.,"; and after "(US)" delete "89012".

In column 1, item (76), after "Karen E. Tieken," delete "1737 Choice Hills Dr.,"; and after "(US)" delete "89012".

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,350,784 B2
APPLICATION NO. : 11/345082
DATED : April 1, 2008
INVENTOR(S) : James B. Tieken et al.

It is certified that error appears in the above-identified patent and that said Letters Patent is hereby corrected as shown below:

In the Claims

Column 7, line 14, after "at least one player" insert --to--.

Column 7, line 15, after "at least one player" insert --to--.

Signed and Sealed this

Seventh Day of October, 2008

JON W. DUDAS
*Director of the United States Patent and Trademark Office*